United States Patent [19]

Anderson

[11] Patent Number: 4,532,672

[45] Date of Patent: Aug. 6, 1985

[54] DOORSTOP HAVING BAYONET ENGAGEABLE BRACKET AND SEPARATELY MOUNTED SHIELD

[75] Inventor: William J. Anderson, Taylorsville, Miss.

[73] Assignee: Enamel Products & Plating Co, McKeesport, Pa.

[21] Appl. No.: 613,331

[22] Filed: May 23, 1984

[51] Int. Cl.[3] ..... E05F 5/06

[52] U.S. Cl. ..... 16/86 A; 16/DIG. 40; 403/349

[58] Field of Search ..... 16/82, 86 R, 86 A, 86 B, 16/86 C, DIG. 40; 292/DIG. 15, DIG. 19; 403/348, 349

[56] References Cited

U.S. PATENT DOCUMENTS

| | | | |
|---|---|---|---|
| 2,899,703 | 8/1959 | Johnson | 16/86 A |
| 3,864,785 | 2/1975 | Hoppock | 16/86 A |
| 3,994,043 | 11/1976 | Gurzenda | 16/86 A |
| 4,197,762 | 4/1980 | Yamana | 403/348 |
| 4,281,895 | 8/1981 | Mohr | 403/348 X |

FOREIGN PATENT DOCUMENTS

| | | | |
|---|---|---|---|
| 2728133 | 5/1979 | Fed. Rep. of Germany | 403/349 |

*Primary Examiner*—Fred Silverberg
*Attorney, Agent, or Firm*—Lee, Smith & Zickert

[57] ABSTRACT

An improved doorstop is disclosed which has a resilient bumper that is independently engageable with a wall mounting bracket, and a cover shield for concealing the bracket from view. The bracket includes independent wall mounting means for affixation to a wall. The resilient bumper has bracket engageable portions that are engageable with the bracket without any additional or separate mechanical fastening elements therebetween. The cover shield is independently engageable with the bumper either before or after the affixation of the bumper to the bracket.

7 Claims, 10 Drawing Figures

DOORSTOP HAVING BAYONET ENGAGEABLE BRACKET AND SEPARATELY MOUNTED SHIELD

BACKGROUND AND SUMMARY OF THE INVENTION

The invention relates to doorstops of the type that are mounted to a wall and protect the wall from damage by disposing a resilient bumper in the path of the doorknob to stop it before hitting the wall.

Prior doorstops in general have utilized three elements: a wall mounting bracket; a resilient bumper; and, a cover shield for concealing the bracket and for engaging with the bracket to support the bumper. These typical doorstops require mechanical fastening of not only the bracket to the wall, but also of the cover shield to the bracket. Thereby, the cover shield holds the bumper to the wall bracket. In order to achieve this, screw holes and tabs have been required on the cover shield to enable affixation with the bracket. Thus, the installer has had to initially mount the bracket to the wall, then place the resilient bumper within a central opening of the cover shield, and lastly, position the cover shield whereby the engageable elements align with corresponding engageable portions on the bracket. At that point, a fastener has been required to be tightened to secure the assembly together. The installer has been required to hold the cover shield in the correct alignment during the fastening steps.

It would be highly desirable to provide an improvement in this type of doorstop so that the mounting bracket is the only element that requires any separate mechanical fastening. It would also be of great benefit to provide a doorstop wherein the resilient bumper is engageable with the mounted bracket without any separate mechanical fasteners therebetween. Additionally, a further goal is to provide a cover shield for concealing the bracket which is mountable with, and carried by, the resilient bumper independently of any engagement with the bracket. This achievement would relieve the installer of any further positioning or mechanical fastening procedures once the bracket is placed on the wall.

The present invention provides an improvement in doorstops which achieves these goals. In brief summary, the improved doorstop comprises a resilient cup-shaped bumper that is provided with tabs which are directly engageable with a wall mountable bracket. The bracket is simply mounted to the wall and thereafter the bumper is independently engaged to the bracket without any separate fasteners. The bumper engages the bracket in a simple insert and twist maneuver whereby to lock the tabs within a tab engaging space defined by flanges on the bracket. A cover shield is resiliently engaged and carried by the bumper independently of the wall mounted bracket.

BRIEF DESCRIPTION OF THE DRAWINGS

The invention is described in greater detail in the following description of the preferred embodiment, taken in conjunction with the drawings, in which.

DESCRIPTION OF THE PREFERRED EMBODIMENT

Figure 1:
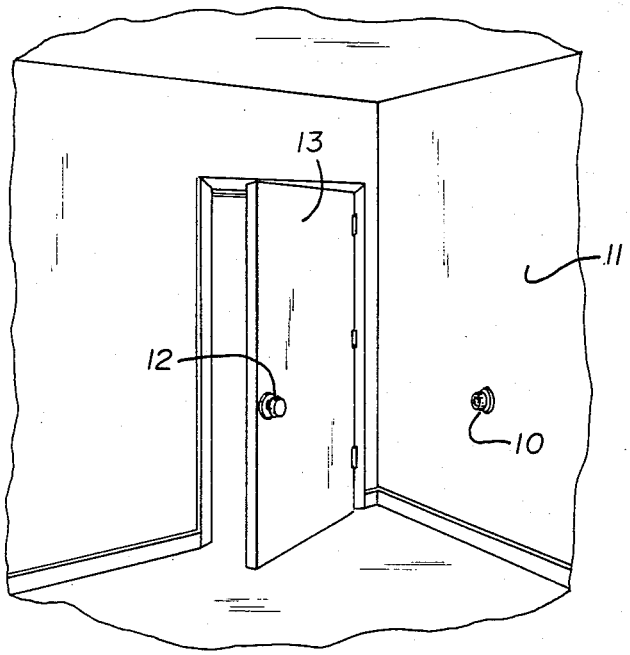
FIG. 1 is a perspective view of a hinged door and an adjacent wall having the improved doorstop of the invention mounted thereon.

In FIG. 1, the invention is embodied in doorstop 10 which is mounted to wall 11 of a typical room arrangement. Doorstop 10 is provided to be mounted in the path of the doorknob 12 of hinged door 13. Thus, damage to wall 11 is prevented by stopping doorknob 12 from bumping wall 11.

Figure 2:
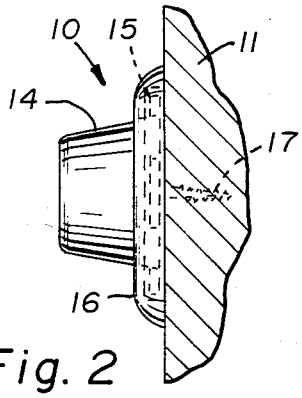
FIG. 2 is a side view of the doorstop as shown in FIG. 1 showing its mounted arrangement with the wall.
Figure 3:
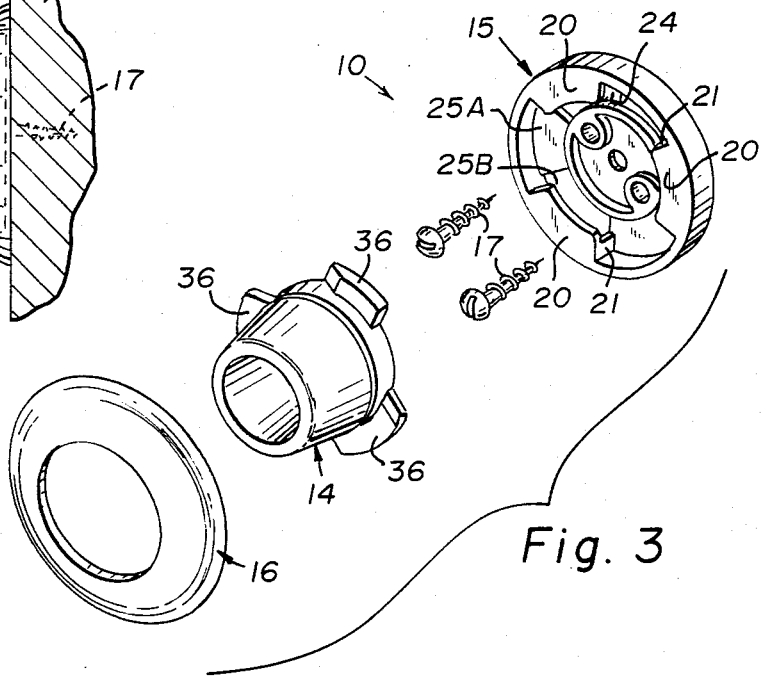
FIG. 3 is an exploded perspective view of the doorstop.

In FIG. 2 a side view of doorstop 10 is shown mounted to the adjacent portion of wall 11. In conjunction with FIG. 3, it will be seen that doorstop 10 comprises a resilient bumper 14 which is engageable to a disc-shaped bracket 15. A cover shield 16 engages around bumper 14 and conceals bracket 15 from view. Mechanical fasteners are only required for mounting the disc-shaped bracket and are provided in the form of pan head screws 17. The assembly and mounting of doorstop 10 is accomplished very quickly and provides for a very sturdy doorstopping arrangement as will be hereinafter explained.

Figure 4:
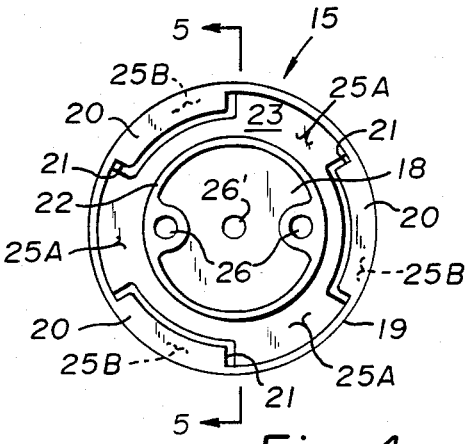
FIG. 4 is a plan view of the wall mounting bracket of the doorstop.
Figure 5:
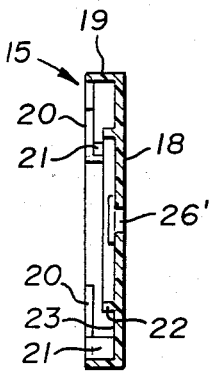
FIG. 5 is a cross-sectional view of the wall mounting bracket taken along Line 5—5 of FIG. 4.

With reference to FIGS. 4 and 5, it will be seen that disc-shaped bracket 15 is illustrated in greater detail. Bracket 15 comprises a generally flat mounting base 18 having a side wall 19 extending around its periphery. A plurality of flanges 20 extend disc-inwardly from side wall 19. Each flange 20 is provided with a stop 21 for positive locking engagement of the resilient bumper as will hereinafter be described. Extending upwardly from base 18, and concentrically with respect to side wall 19, a ridge 22 defines a generally circular channel 23 next to side wall 19. Channel 23 may be described as the rotating path for the engaging tab portions of bumper 14. The base 18 is provided with cutout openings 24 generally below flanges 20 whereby circular channel 23 is open wall-outwardly at these locations.

In the disclosed embodiment, three flanges 20 are provided and are evenly spaced one from the other to provide three receiving spaces 25A therebetween. Beneath flanges 20 an engaging space 25B is provided at each flange for locking engagement with the resilient bumper. In preferred form, the spaces 25A and 25B extend through equal arcs.

Mounting means for bracket 15 is provided in the form of holes 26 extending through base 18 in diametrically opposed relationship inside of ridge 22. Holes 26 are provided to enable fasteners 17 to pass therethrough and penetrate wall 11 for the quick mounting of bracket 15. Another hole 26' may be optionally provided for bracket 15 at the center of base 18. Hole 26' permits the installer to accurately align the bracket 15 at the predetermined point on a wall at where a doorknob would otherwise impact. Thus, the installer simply locates this impact point, marks it with a pencil or the like, and thereafter mounts wall bracket 15 on the wall with hole 26' positioned at the appropriate spot.

Figure 6:
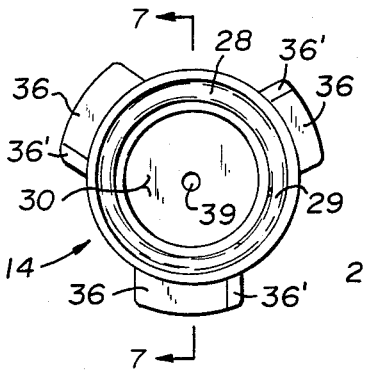
FIG. 6 is a plan view of the resilient bumper of the doorstop.
Figure 7:
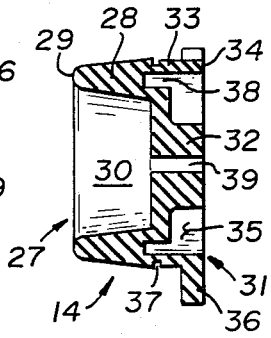
FIG. 7 is a cross-sectional view of the resilient bumper taken along Line 7—7 of FIG. 6.
Figure 8:
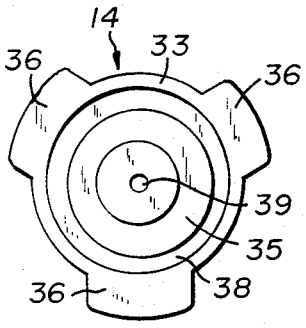
FIG. 8 is a bottom view of the resilient bumper.

The engagement of bumper 14 with bracket 15 will be clear with reference to FIGS. 6, 7 and 8. Bumper 14 comprises a cup-shaped front portion 27 having a circular outer wall 28 which provides a doorbumper rim 29 therearound. A central open cup-portion 30 is surrounded by bumper wall 28. Thereby, doorknobs having internal locking buttons will not inadvertently become locked when contacting the bumper. Bumper 14 further includes a bracket-engageable rear portion 31. Portion 31 includes a central core 32 formed integrally with bumper wall 28 and is separated from an outer wall 33, which is also formed integrally with bumper wall 28. Outer wall 33 is separated from central core 32 to form an annular cavity 35 therebetween. Annular cavity 35 is provided in a sufficient width whereby to accommodate the heads of screw fasteners 17 as would be clear.

Engagement between bumper 14 and bracket 15 is achieved by means of a plurality of tabs 36 extending outwardly from wall 33 generally adjacent its rear edge 34. In the disclosed embodiment three tabs 36 are provided to engage in spaces 25B below each of the three flanges 20. Tabs 36 have an arcuate length no greater than receiving spaces 25A to enable the tabs 36 to be inserted initially along circular channel 23 between flanges 20. Upon affixing bracket 15 to a wall, bumper 14 is simply manually placed adjacent bracket 15 and moved toward the bracket until tabs 36 are arranged within the receiving spaces 25A. By a simple rotation of bumper 14, the tabs 36 are rotated beneath flanges 20 into the engaging spaces 25B. Since the bracket 15 is provided with openings 24 along channel 23, and residing below flanges 20, tabs 36 may be slightly thicker than the distance between the channel 23 and flange 20 whereby a wedging engagement between the wall and flange can be achieved for tight securement of the tabs therebetween.

In the preferred embodiment, the tabs 36 are made to be rotatable in a counter-clockwise rotation for engagement with receiving spaces 25B. Stops 21 are contacted by tabs 36 at full rotational engagement and prevent the tabs from being rotated too far. Additionally, the leading edges of tabs 36 are bevelled at 36' to facilitate the wedging insertion beneath flanges 20. In the illustrated mode, bracket 15 comprises a hard durable plastic while bumper 14 is made of a soft pliable rubber which prevents marring of doorknobs. Additionally, a soft pliable rubber material aids in attaining a tight wedging engagement of tabs 36.

Central core 32 is provided with a diameter defined by the distance between the mounting holes 26. Core 32 provides a resilient thickness which aids in absorbing the shock of an impacting doorknob on the cup-portion. The internal diameter of the outer wall 33, extending around central core 32 and defining cavity 35, is provided whereby to be slightly greater than the diameter of concentric ridge 22. Thus, it is envisioned that an overlapping frictional engagement of the outer wall 33 around ridge 22 enhances a tight resilient engagement of the bumper to the bracket and positively positions tabs 36 within channel 23 during rotational engagement into the locked position at spaces 25B.

A continuous annular groove 37 extends around the outer wall 33 of the bumper and generally defines the boundary between the cup-shaped front portion 27 and bracket engageable rear portion 31. Annular groove 37 provides means for the engagement of cover shield 16 as will be discussed below. A notch 38 is provided within bumper wall 28 and comprises an expansion of cavity 35. Notch 38 extends in a direction toward rim 29 a sufficient distance to extend past annular groove 37. Groove 37 thereby is cut around a relatively thinner wall portion which achieves the purpose of allowing the annular groove to be sufficiently inwardly distortable for engagement of a tightly fitting cover shield 16 therein.

To further enable a proper positioning of doorstop 10 in relation to the path of a doorknob, bumper 14 is provided with the optional feature of a centering hole 39. Hole 39 is a central passage through core 32 and opens at opposite sides thereof as most clearly illustrated in FIG. 7. When bumper 14 is engaged with bracket 15, hole 39 becomes axially arranged over alignment hole 26'. Thereby, prior to inserting fasteners 17 within mounting holes 26, the installer has the option of initially engaging the bumper with the bracket and holding them on wall 11 over the impact point of doorknob 12 as determined by simply swinging door 13 open toward wall 11 and placing the bumper at a position on the wall where the doorknob will centrally strike it. Then, by using a thin tool, such as an awl or center punch, a center mark can be made on the wall by inserting the tool through holes 39 and 26' to contact wall 11. Thereafter, the bumper is disengaged from the bracket, and by aligning hole 26' over the mark the bracket may then be mounted on the wall by means of fasteners 17 as explained.

Figure 9:
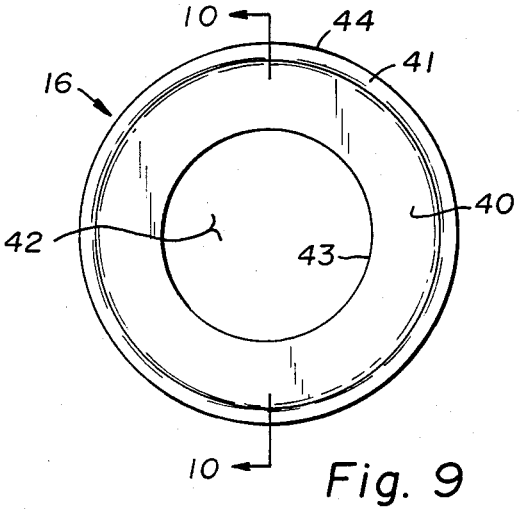
FIG. 9 is a plan view of the cover shield of the doorstop.
Figure 10:
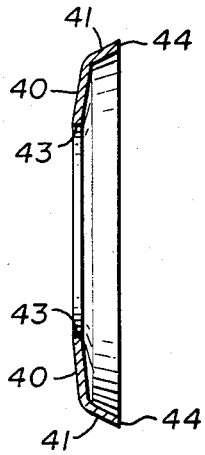
FIG. 10 is a cross-sectional view of the cover shield taken along Line 10—10 of FIG. 9.

With reference to FIGS. 9 and 10, cover shield 16 is shown and has a generally donut-shaped circular configuration. An annular skirt 40 is formed integrally with a projecting lip 41 capable of extending around bracket 15, as best viewed in FIG. 2. A central circular opening 42 is defined by a continuous internal circumferential edge 43, which is the inward boundary of skirt 40. Internal edge 43 is provided in close-tolerance to the diameter of bumper wall 28 taken adjacent to annular groove 37. Thus, after mounting bracket 15, and the locking engagement of bumper 14, cover shield 16 may be placed over the bumper whereby internal edge 43 resiliently is forced around bumper wall 28 to ultimately snap into annular groove 37. The outside diameter of cover shield 16 is defined by outer edge 44 which is the free end of lip 41, as drawn in FIG. 10. Outer edge 44 has a diameter slightly larger than the bracket 15 whereby to conceal bracket 15 from view. Accordingly, lip 41 projects from skirt 40 a sufficient distance to extend over bracket 15 and abut the surface of wall 11, as also shown in FIG. 2.

Cover shield 16 may be engaged with bumper 14 prior to mounting the bumper on the bracket. This is made possible because the cover shield 16 is independently mountable with the bumper and requires no mechanical affixation to bracket 15. In preferred form, cover shield 16 does not even contact bracket 15. Thus, an installer may simply place the cover shield around the bumper and thereafter mount the bumper to the bracket. A sure locking is achieved since ridge 22 holds wall 33 in the correct location and also because the tabs 36 are prevented from rotating out of engagement due to stops 21 determining the length of arcuate travel within receiving spaces 25A.

A counter-clockwise rotational engagement is desired in order to deter, or at least momentarily detain, vandals from attempting to remove the doorstop 10 from a wall. Conventional threaded devices disengage by rotation in the counter-clockwise direction, such as a typical wood or machine screw. Thus, the stops 21 frustrate vandalism by requiring an unconventional disengagement by rotation in the clockwise direction. While this provision serves an anti-vandalism feature, the invention should not be construed as being so limited, and therefore can be constructed to have a conventional clockwise rotational engagement of the tabs beneath the flanges.

In the disclosed embodiment three sets of tabs 36 and corresponding flanges 20 are provided. It would be apparent to one skilled in the art that two sets would be equally suitable for use in practicing the invention, and greater than three are also envisioned.

The invention achieves an improvement in doorstops of the explained variety by eliminating the need to affix the cover shield 16 to the bracket 15. The installer need only quickly engage two mechanical fasteners 17 and thereafter require no further tools for mounting the doorstop 10. Also, by providing the resilient engagement of cover shield 16 to bumper 14, the cover shield may be made in a very light weight and not be required to have thickened tabs or threaded holes, which in the past have been needed to permit mechanical fastening with a wall mounted bracket. As a result, bracket 15 can be made of a less expensive material such as plastic, rather than the predominantly used metal brackets of the prior art.

What is claimed is:

1. A wall mountable doorstop comprising a disc-shaped bracket having a base and circumferential side wall extending therefrom, the base including wall mounting means and a concentric ridge spaced inwardly of said side wall and forming a circular channel therewith, said side wall having a plurality of evenly spaced-apart and inwardly directed flanges extending over said channel, a resilient bumper having a cup-shaped front portion and a bracket-engageable rear portion having an outer wall spaced from a central core to form an annular cavity therewith, the outer wall terminating in a rear edge having an internal diameter no less than the concentric ridge of the bracket, a plurality of evenly spaced-apart tabs extending outwardly from said outer wall generally adjacent the rear edge thereof, said tabs defining an outside diameter no greater than the bracket side wall diameter whereby to be capable of being arranged within said circular channel of the bracket so that upon rotating said bumper said tabs wedge beneath said bracket flanges, said outer wall further including an external continuous groove therearound, and, a bracket-concealing cover shield having a circular opening therethrough with an internal edge thereof having a diameter sufficient for said edge to engage within the continuous groove whereby the cover shield is adapted to be solely supported and carried by said bumper, wherein the bracket wall mounting means facilitates a mechanical fastening of the bracket to a wall independently of said cover shield, and wherein the bumper is engageable directly to the bracket and separately engageable directly with the cover shield, said cover shield thereby capable of being secured to and carried by the bumper and adapted to be arranged to conceal the bracket after said bracket is mounted to a wall, whereby the improved doorstop eliminates separate mechanical fastener means for mounting the bumper with the bracket and for engaging the bumper with the cover shield.

2. The doorstop as in claim 1 wherein the bracket comprises plastic.

3. The doorstop as in claim 1 wherein the means for mounting the bracket comprises openings through the base thereof for passage of mechanical fasteners therethrough to be engageable with a wall.

4. The doorstop as in claim 1 wherein the bracket flanges include stops determining the extent of rotational motion of the tabs therebeneath.

5. The doorstop as in claim 4 wherein the rotational engagement of the tabs beneath the flanges is achieved by a counter-clockwise turning motion.

6. The doorstop as in claim 1 wherein the tabs and flanges have equal arcuate lengths.

7. The doorstop as in claim 1 wherein the bumper tabs are beveled to facilitate wedging engagement thereof beneath the bracket flanges.

* * * * *